US007325310B2

(12) United States Patent
Kim

(10) Patent No.: US 7,325,310 B2
(45) Date of Patent: Feb. 5, 2008

(54) METHOD FOR MANUFACTURING A MONOLITHIC INK-JET PRINTHEAD

(75) Inventor: Yun-ki Kim, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 186 days.

(21) Appl. No.: 11/332,276

(22) Filed: Jan. 17, 2006

(65) Prior Publication Data

US 2006/0114294 A1 Jun. 1, 2006

Related U.S. Application Data

(62) Division of application No. 10/418,078, filed on Apr. 18, 2003, now abandoned.

(30) Foreign Application Priority Data

Sep. 4, 2002 (KR) ..... 2002-53158

(51) Int. Cl.
*B21D 53/76* (2006.01)
*H05B 3/06* (2006.01)
*B44C 1/22* (2006.01)

(52) U.S. Cl. ..... 29/890.1; 29/611; 216/27; 216/41; 216/47; 347/47; 347/54; 347/56

(58) Field of Classification Search ..... 29/611, 29/890.1; 216/27, 41, 47; 347/26, 44, 47, 347/54, 56, 61, 65
See application file for complete search history.

(56) References Cited

U.S. PATENT DOCUMENTS 4,956,653 A 9/1990 Braun ..... 347/63
5,524,784 A 6/1996 Shiba et al.
6,022,482 A 2/2000 Chen et al.
6,155,674 A 12/2000 Figueredo et al. ..... 347/63
6,409,312 B1 * 6/2002 Mrvos et al. ..... 347/54
6,508,946 B1 * 1/2003 Murakami ..... 216/27
6,682,177 B2 1/2004 Hsu et al. ..... 347/63

FOREIGN PATENT DOCUMENTS

JP 63-265647 * 11/1988 ..... 29/890.1

OTHER PUBLICATIONS

Lee et al., "A Thermal Inkjet Printhead with a Monolithically Fabricated Nozzle Plate and Self-Aligned Ink Feed Hole", IEEE Journal of Microelectromechanical Systems, vol. 8, No. 3, Sep. 1999, pp. 229-236.*

* cited by examiner

*Primary Examiner*—A. Dexter Tugbang
(74) *Attorney, Agent, or Firm*—Staas & Halsey LLP

(57) ABSTRACT

A method for manufacturing an ink-jet printhead by coating a first photosensitive photoresist on the substrate and forming a passage plate, forming an ink chamber and an ink passage on the passage plate, burying the ink chamber and the ink passage using a second photoresist and forming a mold layer, forming a chamber cover layer on a top surface of the passage plate and the mold layer, forming a plurality of slots corresponding to the ink chamber and/or the ink passage in the chamber cover layer, supplying an etchant to the second photoresist through the slots and removing the second photoresist remaining in the ink chamber and the ink passage, and coating a third photoresist and forming a nozzle plate on the chamber cover layer.

6 Claims, 8 Drawing Sheets

METHOD FOR MANUFACTURING A MONOLITHIC INK-JET PRINTHEAD

CROSS-REFERENCE TO RELATED APPLICATIONS

This application is a divisional of application Ser. No. 10/418,078, filed Apr. 18, 2003, now abandoned, which is incorporated herein by reference. This application claims the priority of Korean Patent Application No. 2002-53158, filed on Sep. 4, 2002, in the Korean Intellectual Property Office, the disclosure of which is incorporated herein in its entirety by reference.

BACKGROUND OF THE INVENTION

1. Field of the Invention

The present invention relates to a monolithic ink-jet printhead and a method for manufacturing the same, and more particularly, to a monolithic ink-jet printhead in which an ink chamber and a nozzle are effectively and easily formed, and a method of manufacturing the same.

2. Description of the Related Art

In general, ink-jet printheads eject ink droplets using an electro-thermal transducer (ink-jet type), which generates bubbles in ink by means of a heat source.

FIG. 1 is a schematic perspective view illustrating the structure of a conventional ink-jet printhead, and FIG. 2 is a schematic cross-sectional view of the ink-jet printhead shown in FIG. 1. Referring to FIGS. 1 and 2, an ink-jet printhead includes a manifold (not shown) to which ink is supplied, a substrate on which a heater 12 and a passivation layer 11 protecting the heater 12 are formed, a passage plate 2 which forms an ink passage 22 and an ink chamber 21 on the substrate 1, and a nozzle plate 3 which is formed on the passage plate 2 and has an orifice 31 corresponding to the ink chamber 21.

In general, a passage plate and a nozzle plate are formed by a photolithography process using polyimide. In a conventional ink-jet printhead, the passage plate and the nozzle plate are formed of the same material, for example, polyimide. The nozzle plate may be easily detached from the passage plate due to a weak adhering property of polyimide.

In order to solve this problem, in a conventional method for manufacturing an ink-jet printhead, when a passage plate and a nozzle plate are formed of polyimide as separate layers as described above, the passage plate and the nozzle plate are separately formed and are bonded on a substrate. In this method, due to several problems including structural misalignment, the nozzle plate cannot be attached to a substrate such as a wafer, and the nozzle plate should be attached to each chip separated from the wafer. Thus, this method is very disadvantageous for production. Also, when the passage plate and the nozzle plate are formed of polyimide, the passage plate and the nozzle plate easily come off, thus resulting in a decreased yield.

Meanwhile, in conventional methods for manufacturing an ink-jet printhead disclosed in U.S. Pat. Nos. 5,524,784 and 6,022,482, a mold layer is used as a sacrificial layer to form an ink chamber and an ink passage.

In the conventional methods, a sacrificial layer is formed of a photoresist on a substrate to correspond to patterns of an ink chamber and an ink passage, polyimide is coated to a predetermined thickness on the sacrificial layer, and a passage plate and a nozzle plate are formed as a single body. Then, an orifice (nozzle) is formed in the nozzle plate, and the sacrificial layer is finally removed such that the ink chamber and the ink passage are formed below the nozzle plate. In the conventional methods for forming an ink passage and a nozzle using the mold layer, the passage plate and the nozzle plate are formed of polyimide in order to protect the mold layer. However, the polyimide plates and the mold layer cannot be hard-baked at a sufficient temperature, since the mold layer is formed of a photoresist having a low heat-resistant property. Thus, due to the mold layer composition, the passage plate or nozzle plate formed of polyimide cannot be hard-baked. However, the non-hard-baked passage plate or nozzle plate is damaged by an etchant when the mold layer used to form the ink passage and the ink chamber is removed. In particular, a portion where the passage plate contacts the nozzle plate is etched, and an interface between the passage plate and the nozzle plate damaged by the etchant becomes unstable, and thus becomes loose.

SUMMARY OF THE INVENTION

The present invention provides an ink-jet printhead in which a nozzle plate and a passage plate are well adhered to each other due to a high adhering property, and a method of manufacturing the same.

The present invention further provides an ink-jet printhead that solves a problem in which a nozzle plate cannot be hard-baked by forming the nozzle plate when a mold layer already exists, unlike in the prior art, and a method for manufacturing the same.

The present invention further provides an inkjet printhead that has a very stable structure and an improved durability, and a method for manufacturing the same.

Additional aspects and advantages of the invention will be set forth in part in the description which follows and, in part, will be obvious from the description, or may be learned by practice of the invention.

According to one aspect of the present invention, an ink-jet printhead includes a substrate on which a heater and a passivation layer protecting the heater are formed, a passage plate which forms an ink chamber corresponding to the heater and an ink passage connected to the ink chamber, and a nozzle plate in which an orifice corresponding to the ink chamber is formed. A chamber cover layer, which covers the ink chamber and the ink passage, is formed between the nozzle plate and the passage plate, and a plurality of slots corresponding to the ink chamber and/or the ink passage connected to the ink chamber are formed in the chamber cover layer.

The slots are formed to correspond to the ink chamber and the ink passage plate. The chamber cover layer is formed of metals which can be deposited through vapor deposition or sputtering. Alternatively, the chamber cover layer is formed of a silicon-family low-temperature fusing material, preferably, a material selected from a group of $SiO_2$, SiN, and SiON, which can be deposited through plasma enhanced chemical vapor deposition (PECVD).

The passage plate and the nozzle plate are formed of the same material, preferably, polyimide.

The size of each of the slots formed in the chamber cover layer is adjusted to a size that a liquid material used to form the nozzle plate cannot pass through.

According to another aspect of the present invention, a method of manufacturing an ink-jet printhead comprises preparing a substrate on which a heater and a passivation layer protecting the heater are formed, coating a first photosensitive photoresist on the substrate and forming a passage plate, forming an ink chamber corresponding to the heater and an ink passage connected to the ink chamber on the passage plate, burying the ink chamber and the ink passage formed on the passage plate using a second photoresist and forming a mold layer, forming a chamber cover layer which covers the ink chamber and the ink passage on a top surface of the passage plate and the mold layer, forming a plurality of slots corresponding to the ink chamber and/or the ink passage in the chamber cover layer, supplying an etchant to the second photoresist through the slots and removing the second photoresist remaining in the ink chamber and the ink passage, coating a third photoresist and forming a nozzle plate on the chamber cover layer, and forming an orifice corresponding to the ink chamber between the nozzle plates.

The passage plate and the nozzle plate are formed of either a negative-type photoresist or a polyimide, preferably, the polyimide.

The chamber cover layer is formed of a silicon-family low-temperature fusing material, preferably, a material selected from a group of $SiO_2$, SiN, and SiON, which can be deposited through plasma enhanced chemical vapor deposition (PECVD).

After forming the orifice, the method may further comprise performing a flood exposure on the top surface of the nozzle plate and hard-baking the nozzle plate. Next, the method may further comprise forming an ink supply hole through which ink is supplied to a bottom surface of the substrate.

The method may further comprise, between preparing the substrate and coating the first photosensitive photoresist, forming an ink supply channel, which supplies ink to the ink chamber through the ink passage and has a bottom in which an ink supply hole connected to the ink passage is to be formed, on the bottom surface of the substrate to a predetermined depth.

The size of each of the slots formed in the chamber cover layer may be adjusted to a size through which the third photoresist cannot pass due to its viscosity.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
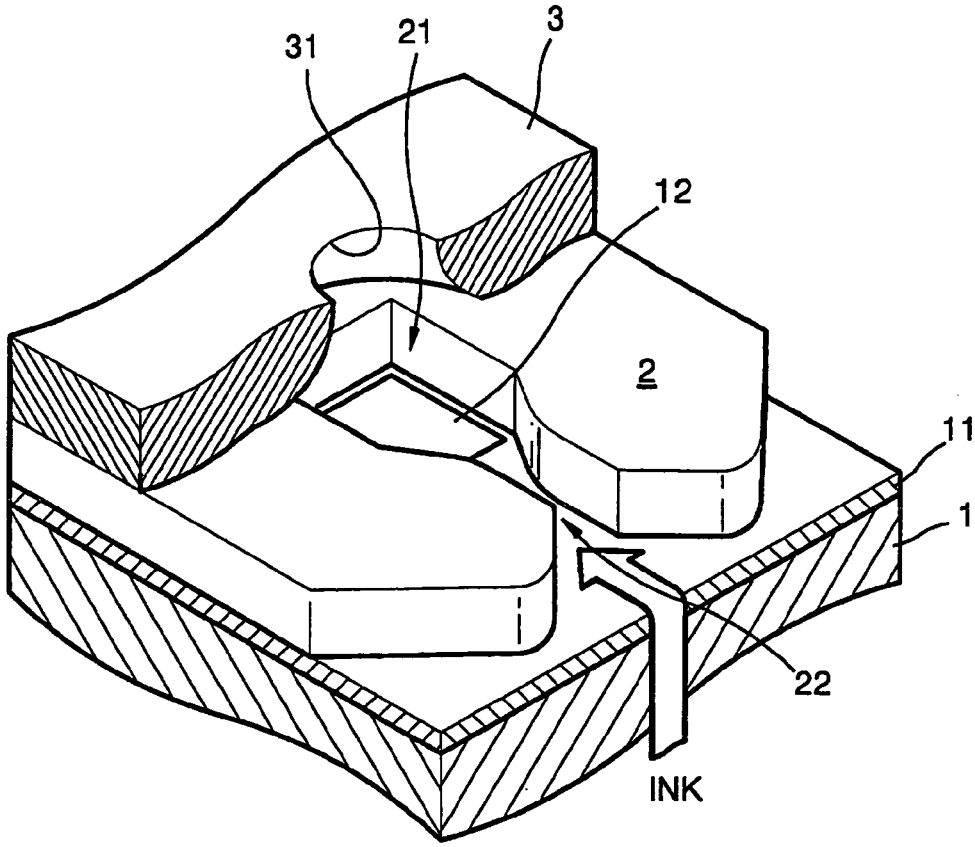
FIG. 1 (PRIOR ART)
FIG. 1 is a schematic perspective view illustrating the structure of a conventional ink-jet printhead.
Figure 2:
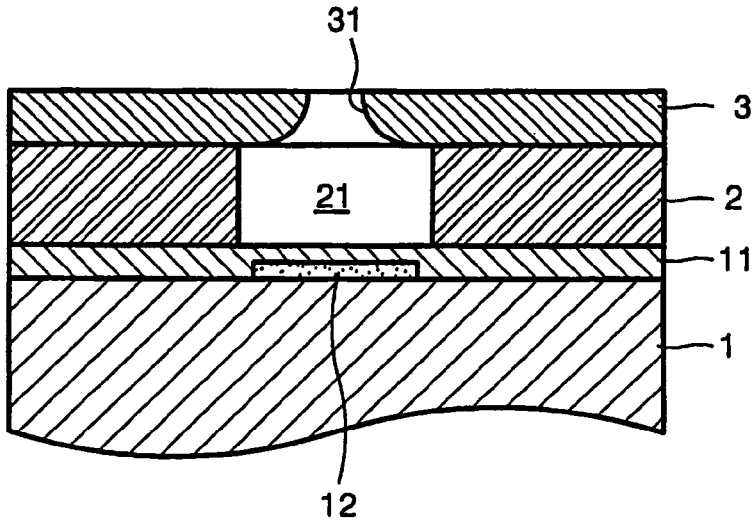
FIG. 2 (PRIOR ART)
FIG. 2 is a schematic cross-sectional view of the ink-jet printhead shown in FIG. 1.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 3:
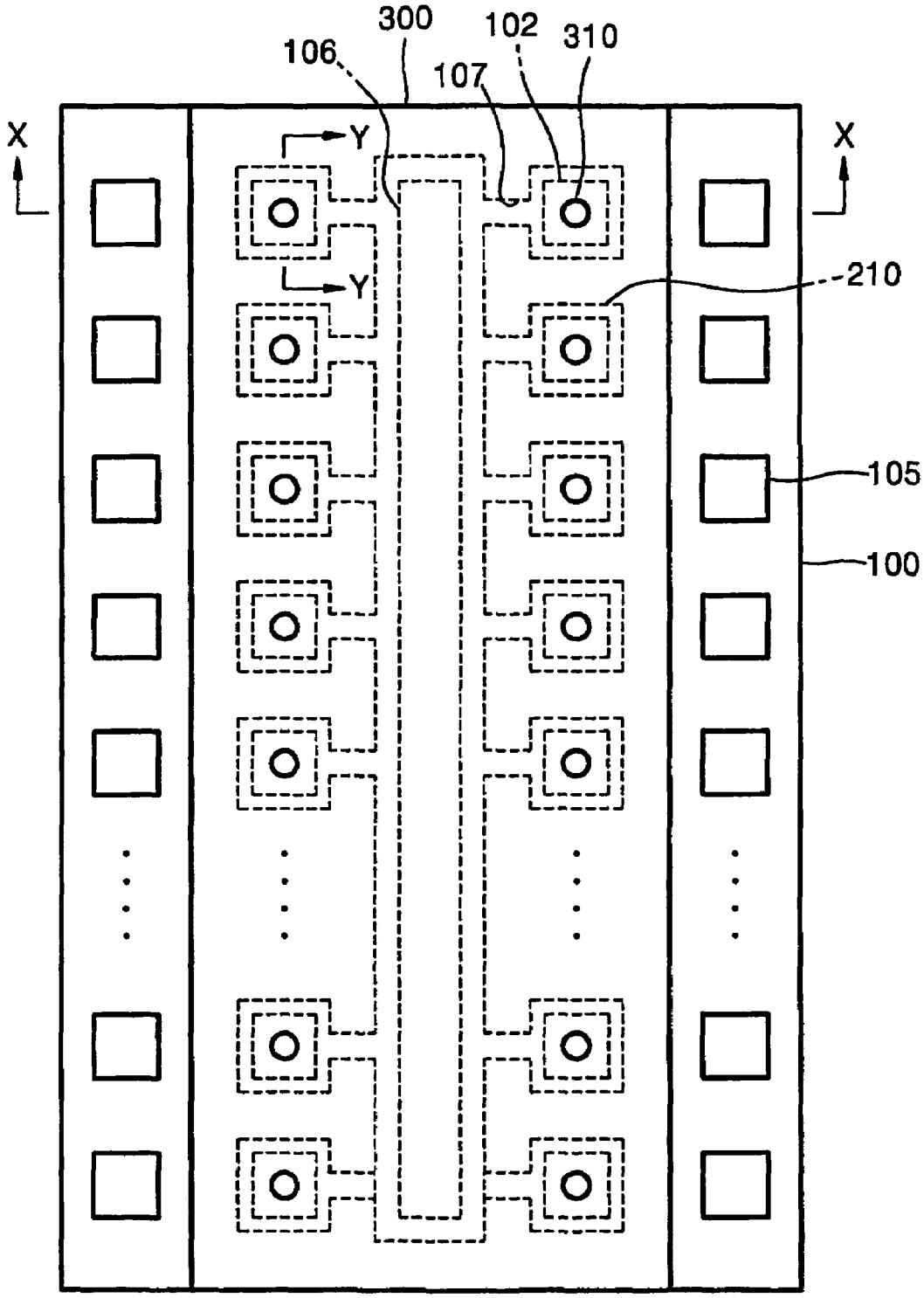
FIG. 3 is a schematic plane view illustrating an embodiment of an ink-jet printhead according to the present invention.
Figure 4:
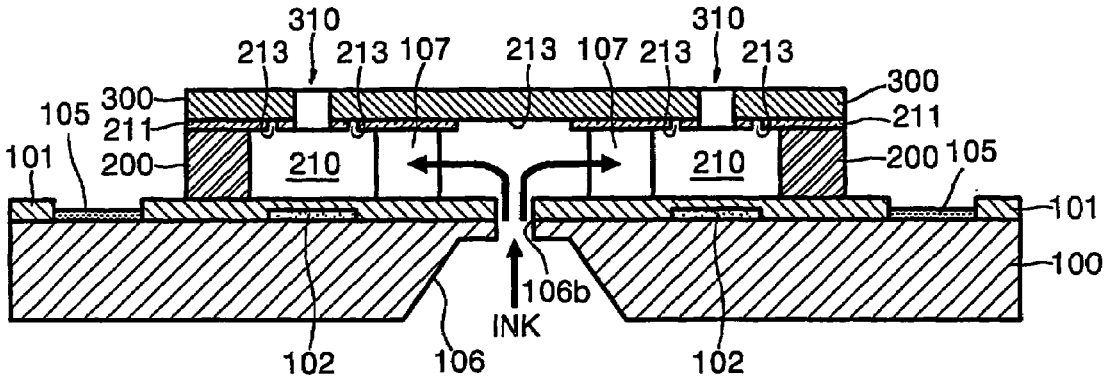
FIG. 4 is a cross-sectional view taken along line X-X of FIG. 3.
Figure 5:
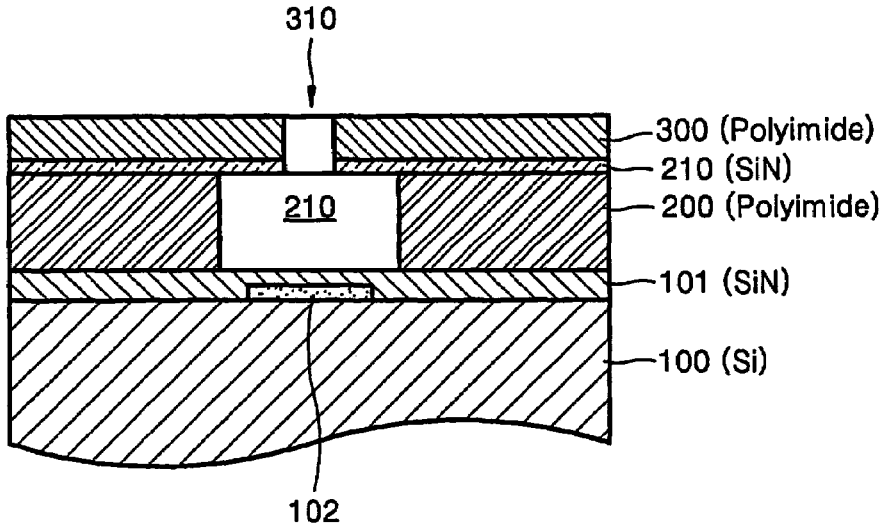
FIG. 5 is a cross-sectional view taken along line Y-Y of FIG. 3.

FIG. 3 is a schematic plane view illustrating an embodiment of an ink-jet printhead according to the present invention, FIG. 4 is a cross-sectional view taken along line X-X of FIG. 3, and FIG. 5 is a cross-sectional view taken along line Y-Y of FIG. 3.

As shown in FIG. 3, pads 105 to be electrically connected to an internal circuit of an ink-jet printhead are arranged in a line along both long sides of a substrate 100 of the ink-jet printhead. The pads 105 may be formed along short sides of the substrate 100 according to design specifications. A nozzle plate 300 is placed between both edges of the substrate 100 on which the pads 105 are formed. As shown in FIGS. 4 and 5, an orifice 310 through which ink droplets are ejected is formed in the nozzle plate 300, and a heater 102 formed on a top surface of the substrate 100 is placed on the bottom of an ink chamber 210 below the nozzle plate 300. The heater 102 is protected by a passivation layer 101. The heater 102 is electrically connected to the pads 102. As shown in FIGS. 3 through 5, the heater 102 is to be formed in the ink chamber 210 determined by a passage plate 200. The ink chamber 210 is connected to an ink supply channel 106 through an ink supply hole **106*b* formed in the substrate 100 by an ink passage 107. In the present embodiment, the nozzle plate 300 and the passage plate 200** are formed of a photoresist, in particular, polyimide.

Referring to FIGS. 4 and 5, a chamber cover layer 211, which is a feature of the present invention, is formed on a bottom surface of the nozzle plate 300. The chamber cover layer 211 may be formed of metals such as Ni and Ti, or a silicon-family material such as $SiO_2$, SiN, or SiON.

Here, the chamber cover layer 211 serves to improve an adhering property between the nozzle plate 300 and the passage plate 200, which are formed of a material such as polyimide having a weak adhering property. This function of improving an adhering property is advantageous in forming the nozzle plate 300 in manufacturing an ink-jet printhead. A portion corresponding to an orifice 310 of the nozzle plate 300 of the chamber cover layer 211 is penetrated, and a slot 213 is formed in the other portion of the chamber cover layer 211. The function of the chamber cover layer 211 having the slot 213 will be described in detail when presenting a method of manufacturing an ink-jet printhead, which will be described later.

Hereinafter, a method of manufacturing the ink-jet printhead according to the present invention will be described in detail with reference to the accompanying drawings. Well-known techniques such as forming a layer and patterning a layer, in particular, well-known techniques for manufacturing an ink-jet printhead will not be specifically described. FIGS. 6A through 6K are process views illustrating a method for manufacturing an ink-jet printhead according to the present invention, which correspond to a cross-section taken along line X-X of FIG. 3.

Figure 6A:
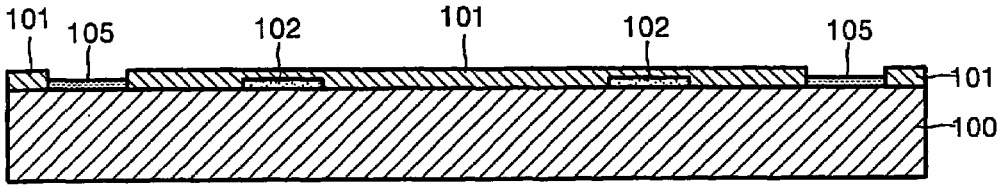
FIGS. 6A through 6K are process views illustrating a method of manufacturing an ink-jet printhead according to an embodiment of the present invention.

As shown in FIG. 6A, a substrate 100 such as a silicon wafer, on which an underlayer including a heater 102 and a SiN passivation layer 101 protecting the heater 102 is formed, is prepared. This operation is performed on a wafer and accompanies forming of a material for use in a heater, patterning, and depositing a passivation layer.

Figure 6B:
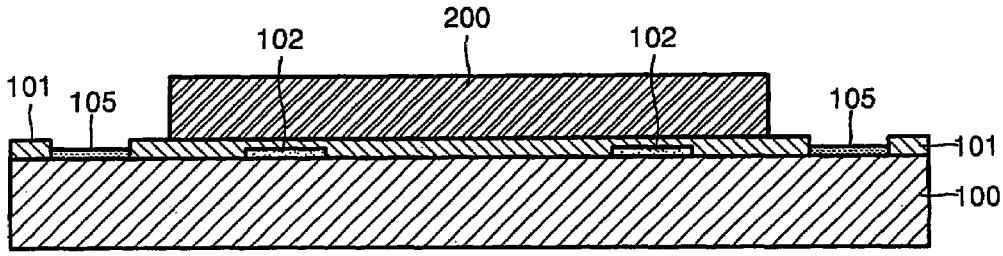

As shown in FIG. 6B, a photoresist, for example, polyimide is coated to a thickness of several microns, for example, to a thickness of 30 microns, substantially on the entire surface of the substrate 100 to form a passage plate 200. Here, a positive-type or negative-type photoresist or polyimide may be used as the passage plate 200.

Figure 6C:
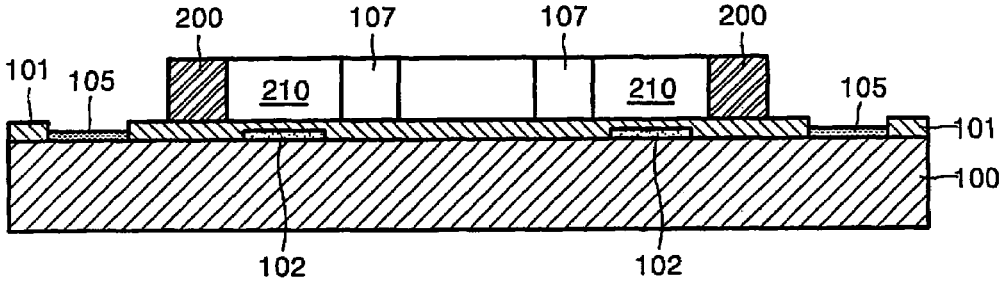

As shown in FIG. 6C, an ink chamber 210 corresponding to the heater 102 and an ink passage 107 connected to the ink chamber 210 are formed on the passage plate 200 by a photolithography process. Here, one technique among various well-known techniques to form the ink chamber 210 and the ink passage 107 is used to form the ink chamber 210 and the ink passage 107. Here, preferably, the passage plate 200 is formed of a negative-type photoresist, in particular, negative-type polyimide.

Figure 6D:
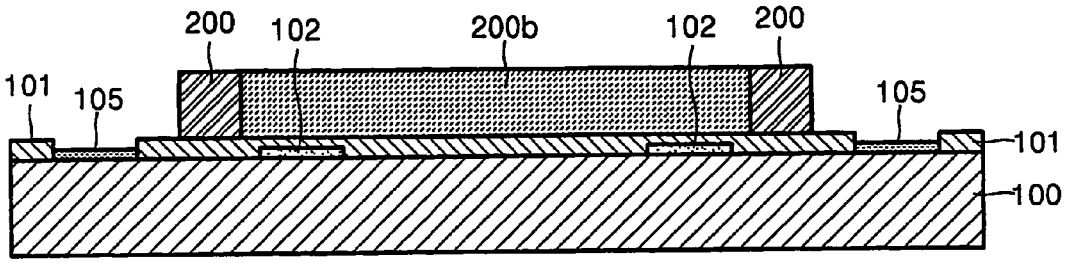

As shown in FIG. 6D, the ink chamber 210 and the ink passage 107 of the passage plate 200 are buried using a second photoresist to form a mold layer 200*b*. Here, an operation of forming the mold layer 200*b* may comprise operations of flood-coating a second photoresist, etching back to allow only the ink chamber 210 and the ink passage 107 to remain, or performing a photolithography process of removing a portion existing on the surface of the passage plate 200.

Figure 6E:
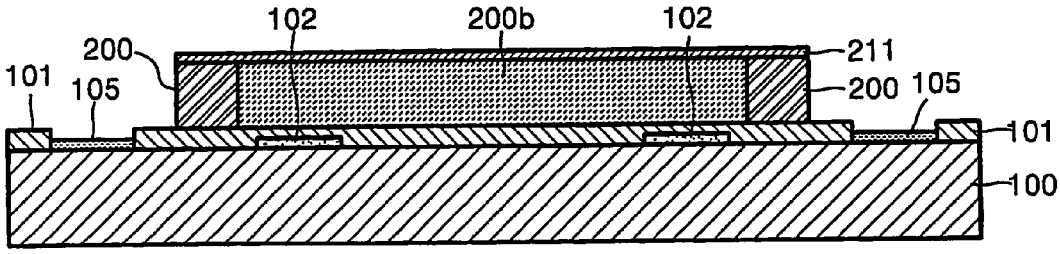

As shown in FIG. 6E, a chamber cover layer 211 having an etch selectivity with respect to the mold layer 200*b* is formed to a predetermined thickness on the passage plate 200 and the mold layer 200*b*. The chamber cover layer 211 may be formed of metals such as Ni and Ti, which can be deposited through vapor deposition or sputtering, or may be formed of a silicon-family material such as $SiO_2$, SiN, or SiON. The silicon-family material can be deposited at a low-temperature atmosphere and can be formed through plasma enhanced chemical vapor deposition (PECVD).

Figure 6F:
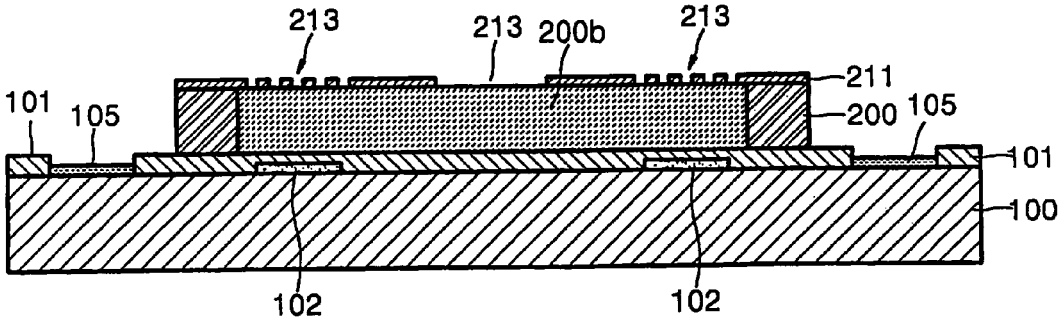
Figure 6G:
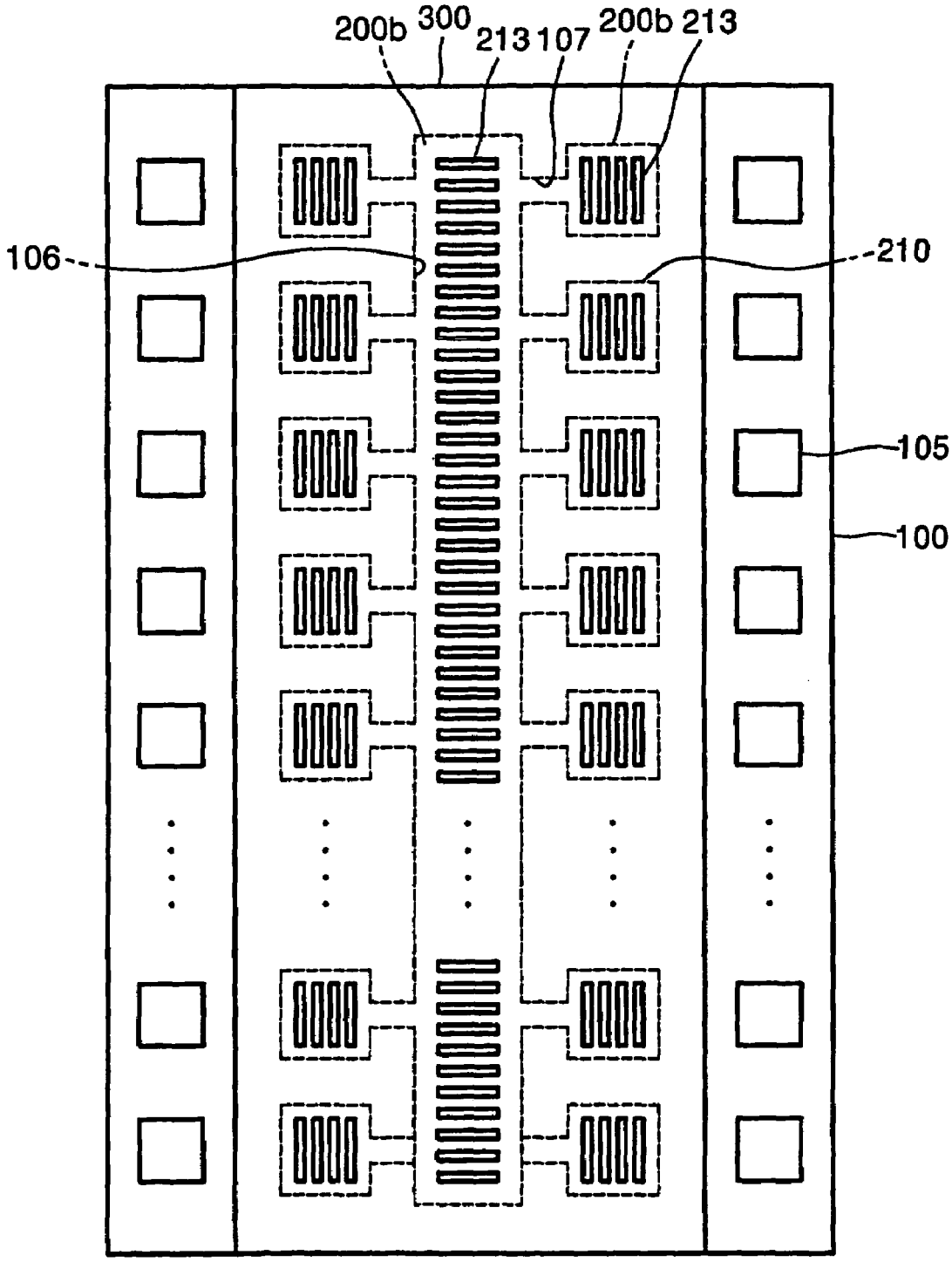

As shown in FIG. 6F, a plurality of slots 213 are formed in the chamber cover layer 211. The slots 213 are formed in portions corresponding to the ink chamber 210 and the ink passage 107, as shown in FIG. 6G. According to another embodiment of the present invention, the slots 213 are formed only in the ink chamber 210 or the ink passage 107. Preferably, however, the slots 213 are formed in both the ink chamber 210 and the ink passage 107. The width of each of the slots 213 is expressed in sub-microns. Each of the slots 213 has a size through which a third photoresist used to form the nozzle plate 300 formed on the slots 213 cannot pass through due to its viscosity, and the length of each of the slots 213 is not greatly limited. Thus, the size of each of the slots 213 should be adjusted according to a property of the photoresist or polyimide used to form the nozzle plate 300. In order to form the slots 213, a photoresist mask having a predetermined pattern is formed in the chamber cover layer 211 and is then patterned by a dry or wet etch process. After the slots 213 are completed, the photoresist mask is removed by an ashing process using plasma or high-temperature heating and a stripping process using an etchant.

Figure 6H:
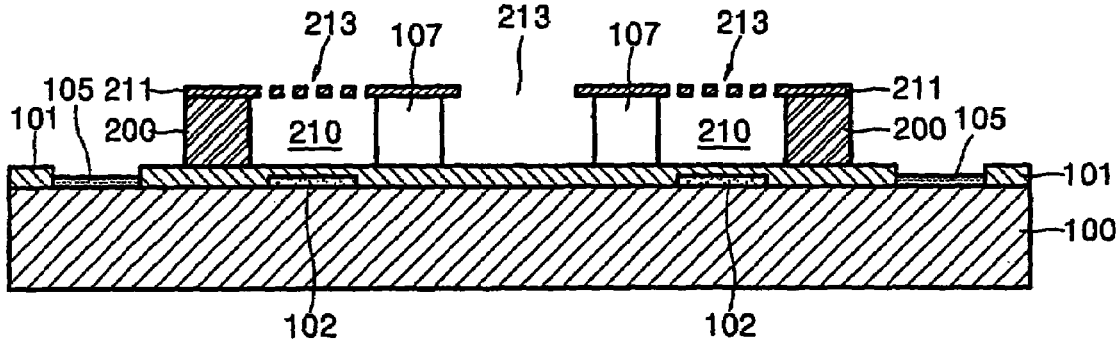

As shown in FIG. 6H, an etchant is supplied to the photoresist mask through the slots 213, and the mold layer 200*b*, as shown in FIG. 6F, is removed from the ink chamber 210 and the ink passage 107. A photoresist used to form the mold layer 210*b* is dissolved by the etchant supplied through the slots 213, and a dissolved photoresist is ejected through the slots 213.

Figure 6I:
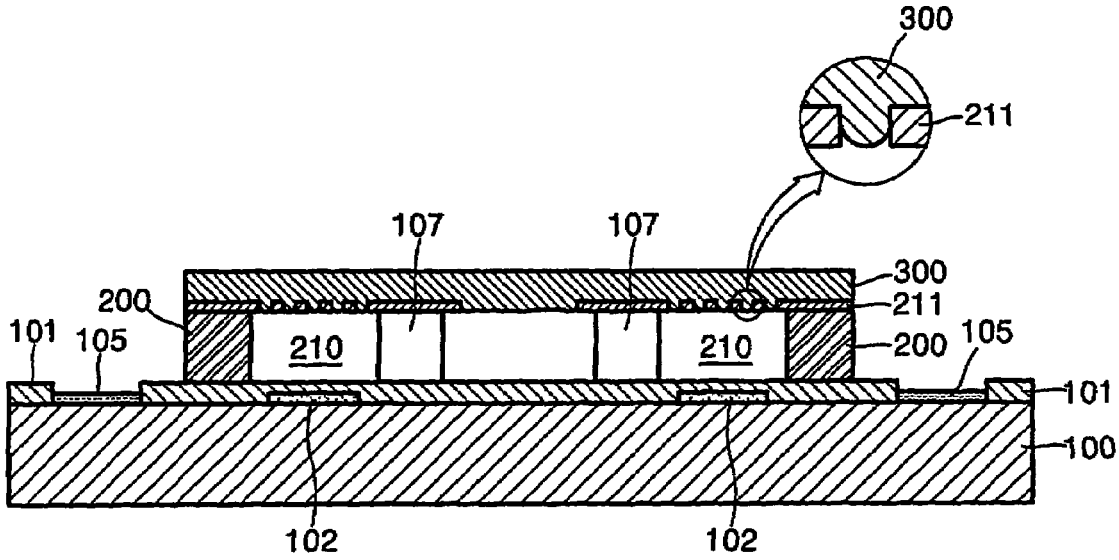

As shown in FIG. 6I, a nozzle plate 300 is formed on a top surface of the chamber cover layer 211 using a third photoresist. In this case, a negative-type photoresist or negative-type polyimide is spin-coated to a predetermined thickness and is then soft-baked. During a spin-coating process, a negative-type photoresist or negative-type polyimide cannot pass through the slots 213 due to its viscosity, and the ink chamber 210 and the ink passage 107 is maintained in a cavity state. Of course, a photoresist or polyimide cannot enter into the ink chamber 210 and the ink passage 107. However, part of the photoresist or polyimide enters into the slots 213. That is, the slots 213 prevent a photoresist or polyimide having viscosity from entering into the ink chamber 210 and the ink passage 107.

Figure 6J:
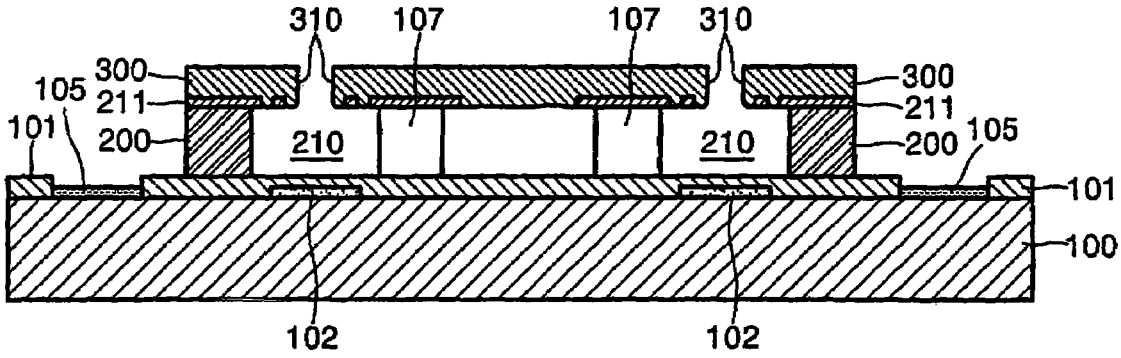

As shown in FIG. 6J, an orifice 310 is formed in the nozzle plate 300 by a photolithography process. In this case, a reticle 410, such as a metal mask, having a pattern corresponding to the shape of an orifice formed in the nozzle plate 300, is used during an exposure process. The orifice 310 is formed by a wet or dry etch process. The chamber cover layer 213 blocked by the orifice 310 is formed by a dry etch process such that the orifice 310 communicates with the ink chamber 210. Subsequently, flood exposure and hard-baking of the nozzle plate 300 are performed.

Figure 6K:
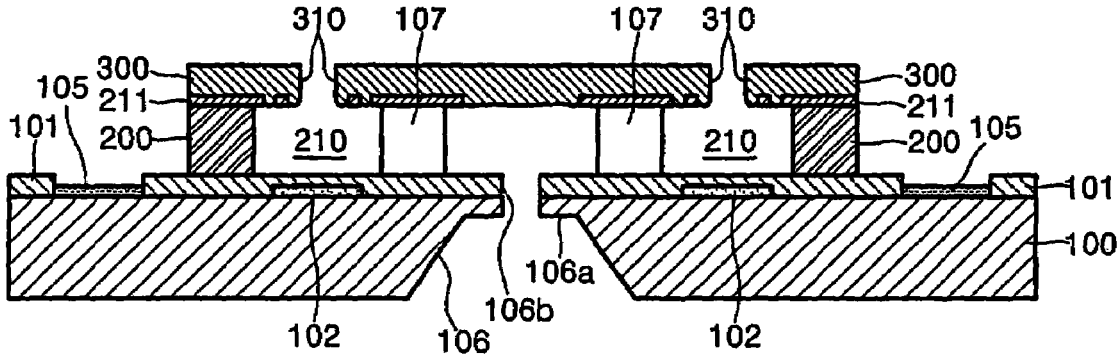

As shown in FIG. 6K, an ink supply channel 106 is formed on the bottom suface of the substrate 210, and an ink supply hole 106*b* which penetrates the substrate 100, is formed using a $XeF_2$ dry etch process by removing the bottom 106*a* of the ink supply channel 106. Thus, an ink supply route on which ink is supplied to a top surface of the substrate 100 from a bottom surface of the substrate 100 is formed on the substrate 100. In this case, the ink supply channel 106 is formed as presented in FIG. 6A or prior to the process described in FIG. 6A, and only the ink supply hole 106*b* can be formed in the present operation.

Also, in addition to the above operation, a hydrophobic coating layer for preventing contamination of the nozzle plate 300 due to ink may be further formed on the top surface of the nozzle plate 300.

As described above, according to the present invention, since a passage plate and a nozzle plate are adhered to each other by a chamber cover layer, an adhering force therebetween is greatly improved. In addition, the nozzle plate can be formed in a state where a mold layer is removed before the nozzle plate is formed. Thus, a problem in which a nozzle plate cannot be hard-baked can be solved by forming the nozzle plate when a mold layer already exists, unlike in the related art. The chamber cover layer is used in the present invention such that the nozzle plate is completed even in a state where an ink chamber and an ink passage are not formed in the passage plate. Thus, according to the present invention, an ink-jet printhead that has a very stable structure and an improved durability can be manufactured.

While this invention has been particularly shown and described with reference to preferred embodiments thereof, it will be understood by those skilled in the art that various changes in form and details may be made therein without departing from the spirit and scope thereof as defined by the appended claims.

Although a few preferred embodiments of the present invention have been shown and described, it would be appreciated by those skilled in the art that changes may be made in this embodiment without departing from the principles and spirit of the invention, the scope of which is define in the claims and their equivalents.

What is claimed is:

1. A method for manufacturing an ink-jet printhead, the method comprising:

preparing a substrate on which a heater and a passivation layer protecting the heater are formed;

coating a first photosensitive photoresist on the substrate to form a passage plate;

forming an ink chamber corresponding to the heater and an ink passage connected to the ink chamber on the passage plate;

burying the ink chamber and the ink passage formed on the passage plate using a second photoresist to form a mold layer;

forming a chamber cover layer which covers the ink chamber and the ink passage, on a top surface of the passage plate and the mold layer;

forming a plurality of slots corresponding to the ink chamber and/or the ink passage in the chamber cover layer;

supplying an etchant to the second photoresist through the slots and removing the second photoresist remaining in the ink chamber and the ink passage;

coating a third photoresist to form a nozzle plate on the chamber cover layer; and forming an orifice corresponding to the ink chamber and the nozzle plate.

2. The method of claim 1, wherein the passage plate and the nozzle plate are formed of either a negative-type photoresist or polyimide.

3. The method of claim 1, wherein the size of each of the slots formed in the chamber cover layer is based on a size through which the third photoresist cannot pass due to a viscosity of the third photoresist.

4. The method of claim 1, wherein the chamber cover layer is formed of a silicon-family low-temperature fusing material.

5. The method of claim 4, wherein the chamber cover layer is formed of a material from a group consisting of $SiO_2$, SiN, and SiON.

6. The method of claim 5, wherein the chamber cover layer is formed through plasma enhanced chemical vapor deposition (PECVD).

* * * * *

UNITED STATES PATENT AND TRADEMARK OFFICE

CERTIFICATE OF CORRECTION

PATENT NO. : 7,325,310 B2
APPLICATION NO. : 11/332276
DATED : February 5, 2008
INVENTOR(S) : Yun-Ki Kim It is certified that error appears in the above-identified patent and that said Letters Patent is hereby corrected as shown below:

Column 8, Line 9, after “material” insert --selected--.

Signed and Sealed this

Fifteenth Day of July, 2008

JON W. DUDAS
*Director of the United States Patent and Trademark Office*